United States Patent [19]

Burmeister et al.

[11] Patent Number: 4,818,242

[45] Date of Patent: Apr. 4, 1989

[54] LAUNDRY CARE PRODUCT FOR FINAL RINSE: AQUEOUS MIXTURE OF CATIONIC SILICONE OIL, CATIONIC FATTY ACID CONDENSATE AND CATIONIC FILM-FORMER

[75] Inventors: Dieter Burmeister, Bad Salzuflen; Joachim Marzinkowski, Düsseldorf, both of Fed. Rep. of Germany

[73] Assignee: Hoffmann's Starkefabriken AG, Fed. Rep. of Germany

[21] Appl. No.: 935,836

[22] Filed: Nov. 28, 1986

[30] Foreign Application Priority Data

Dec. 3, 1985 [DE] Fed. Rep. of Germany ..... 3542725

[51] Int. Cl.[4] ..... C11D 3/37; D06M 13/40; D06M 15/64

[52] U.S. Cl. ..... 8/115.6; 8/137; 252/8.6; 252/8.8; 252/8.9

[58] Field of Search ..... 252/8.6, 8.8, 8.9; 8/115.6, 137

[56] References Cited

U.S. PATENT DOCUMENTS 4,179,382 12/1979 Rudkin et al. ..... 252/8.8
4,289,642 9/1981 Weber et al. ..... 252/99
4,446,032 5/1984 Muntenau et al. ..... 252/8.6

FOREIGN PATENT DOCUMENTS 2155941 5/1973 Fed. Rep. of Germany .
1549180 7/1979 United Kingdom .

OTHER PUBLICATIONS

Grant & Hackh's *Chemical Dictionary,* 5th Edition, p. 531 (1987).
Kirk–Othmer, *Concise Encylopedia of Chemical Technology,* p. 1098 (1985).

*Primary Examiner*—A. Lionel Clingman
*Attorney, Agent, or Firm*—Robbins & Laramie

[57] ABSTRACT

The invention described herein relates to a new post-wash-aid which is preferably added during the final rinse to the washing machine. It is composed of a silicone oil, cationically dispersed in water, a cationic fatty acid condensation product and a cationic film-forming agent.

The silicon oil may partially be replaced by a paraffin wax and/or may also contain an alkoxylated fatty amine in an amount of up to 10% by weight, based on the silicon. Further the invention shows the process of producing this composition.

This composition facilitates ironing, affords the ironed wash an enhanced finish, increases the absorptive capacity of the wash in respect of water and confers a soft and fluffy feel thereto.

34 Claims, No Drawings

LAUNDRY CARE PRODUCT FOR FINAL RINSE: AQUEOUS MIXTURE OF CATIONIC SILICONE OIL, CATIONIC FATTY ACID CONDENSATE AND CATIONIC FILM-FORMER

The invention described herein relates to a new post-wash-aid which is preferably added during the final rinse to the washing machine. It is composed of a silicone oil cationically dispersed in water, a cationic fatty acid condensation product and a cationic film-forming agent.

This composition facilitates ironing, affords the ironed wash an enhanced appearance, increases the absorptive capacity of the wash in respect of water, and confers a soft and fluffy feel thereto.

BRIEF DESCRIPTION OF THE FIGURES

FIG. 1 shows the traction force of an iron on treated and untreated fabric.

FIG. 2 shows comparative values for traction force of an iron on treated and untreated fabric.

The invention concerns a post-wash-aid, particularly an ironing aid.

It is well-known that aqueous dispersions of water-soluble lubricants such as silicone oil, and a water-soluble film forming agent, such as a water-soluble starch derivative, are used as ironing aids for laundry, particularly on cottons. Such a dispersion is sprayed onto the clothes to be ironed, and enables the iron to glide more smoothly over clothes that have been treated, than over untreated material. The film forming agent affords the material a certain degree of stiffness, which is often deemed to be desirable, particularly for shirts and blouses.

Spraying washing by means of a spray can is rather expensive, and therefore such products are usually reserved for shirts and blouses. Furthermore, the well-known dispersion described above does not provide a totally satisfactory effect during ironing. It is difficult to spray the clothes evenly, without making them very wet; this in turn can lead to unwanted spots and streaks in the material. A further disadvantage of the well-known dispersion, is that in spite of a properly functioning spray mechanism, it is often not possible to use up all of the material in the spray can.

The purpose of the invention is to overcome the problems in providing a post-wash-aid for facilitating ironing, which, compared with the well-known ironing aid described above, enables the iron to glide more smoothly over the material, thus making ironing easier, and is also more economical in use.

The problems are solved by means of the ironing aid described in claim 1, which is preferably added to the last rinse during the washing process, thus obviating the need for expensive spray cans.

This ironing aid is a post-wash-aid preferably consisting of (A) An aqueous dispersion, prepared with the aid of a cationic dispersion agent, of a silicone oil applicable to textiles and optionally partly replaceable with a paraffin wax and is optionally an aminofunctional silicone, a quaternised silicone, a silicone elastomer or a mixture thereof, to which components, if desired, an alkoxylated fatty amine in an amount up to 10% by weight based on the silicone is added:

(B) A condensation product of an aliphatic long chain saturated or unsaturated monocarboxylic acid with a polyamine or an addition product of a polyamine with ethylenoxide or propylenoxide:

(C) A cationic film former of the group of cationactive alkoxylated starches and cationactive alkoxylated celluloses:

(D) Water, and if desired (E) Further additions selected from the group: odourants, preservatives, colorants and organic acids used to adjust the pH-value.

According to preferred embodiments component (A) is a silicone oil applicable to textiles with a viscosity between 1000 and 10,000 $mm^2s^{-1}$ at 25° C. This silicone oil is perferably an alkyl silicone oil, especially a methyl silicone oil with a viscosity from 1000 to 10,000 $mm^2s^{-1}$. Preferably the cationic dispersing agent for component A is a cationactive imidazolinium salt of the formula

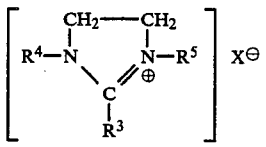

wherein $R^3$ is a long chain saturated or unsaturated hydrocarbon radical having 10 or more carbon atoms, $R^4$ is hydrogen or an optionally substituted alkyl radical having 1 to 5 carbon atoms, $R^5$ is a lower alkyl radical and X is an anionic radical or an anionic group.

In a preferred composition according to the invention component (A) is present in an amount of from 0.5 to 20% by weight, component (B) is present in an amount of from 0.5 to 15% by weight, and component (C) is present in an amount of from 1 to 15% by weight, the remainder being water.

Not only does this invention allow smoother and easier ironing, than with the well-known and previously described ironing aids, but it also increases the absorptivity of fabrics for water and imparts a soft, fluffy feel to the fabric so that after ironing the clothes take on a more elegant soft appearance. The activity of the post-wash-aids of the invention is considered as remarkable, since it has always been considered impossible to obtain all the desired effects described above and, in particular, a combination of softness and water absorption. To date, post-wash products have included so-called fabric softeners for obtaining the required fluffiness: these agents contain quaternary ammonium compounds with long chain alkyl radicals. Such agents are for addition to the final rinse in the washing machine, and impart to the wash—particularly towels and knitted garments—a soft hand; however, although they make ironing a little bit easier, they are not ideally suitable for the post-wash treatment of clothes ready to be ironed. A major disadvantage of such fabric softeners is their hydrophobic action particularly on cotton; they also produce a significant reduction in the absorptivity of the laundry.

Thus the post-wash-aid of the present invention is not only superior as an ironing aid in comparison with existing, well-known ironing aids, but is also a substance which softens the wash as well as making it look and feel softer, without at the same time reducing the absorptive capacity of the laundry or washing. Following the use of the composition of the invention, the clothes can be ironed dry, and the iron glides more smoothly over dry clothes that have been previously treated, than over damp ones. Only in the case of very marked creases is it necessary to dampen the material prior to ironing. It is well-known that a steamiron cannot be used on clothes which have been treated with the well-known prior ironing aids, with the composition of this invention, no problems occur relating to steam- or damp ironing.

DE-A No. 26 31 419 shows a post-wash-aid which may be also added to the last rinse in a washing machine and which also contains a silicone oil as does the present agent. In this prior art, however, no alkoxylated starches and celluloses are used which according to this invention raise in a surprising way not only of the fluffiness or fullness and the smoothness but also the absorptivity (and thus ability to dry) of the treated fabrics. In the prior art publication roasted dextrines are used which only act as thickeners.

Furthermore, according to this invention fatty acid amides are used contrary to the use of fatty acid amines in prior art. This causes a lower re-soiling and they are easier to hydrolyse than amines and thus may be better washed out of the fabric. Furthermore, they are easier to decompose and thus, better suited with respect to ecological reasons than amines.

The cationic silicone oil dispersed in water (component A) ) is a silicone oil that can be used on textiles, has a viscosity between 500 and 50,000 $mm^2s^{-1}$ at 25° C., more particularly, 1000 to 10,000 $mm^2s^{-1}$ at 25° C. as described in "Textilveredelung", 19, (1984), No. 5 at pp 144 to 145. Especially appropriate are alkyl silicone oils, more particularly methyl silicone oil, of viscosity 1000 to 10,000 $mm^2s^{-1}$.

Preferably the post-wash-aid of the invention can include paraffin wax as a part replacement for the silicone oil. The wax preferably has a melting point of ≧40° C., particularly 50° to 60° C.

As component (A), also an amino-functional siloxane can be used as the silicone oil, this preferably has the following structural formula:

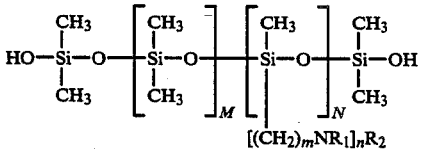

wherein $R^1$=H $R^2$=$R^1$=—$CH_2$—$CH_3$ m=2 to 3 n=1 to 2

M=50 to 2000

N=0.1% to 2% nitrogen

Furthermore, the silicone oil of component (A) could be quaternised siloxane, which preferably conforms to the following structural formula:

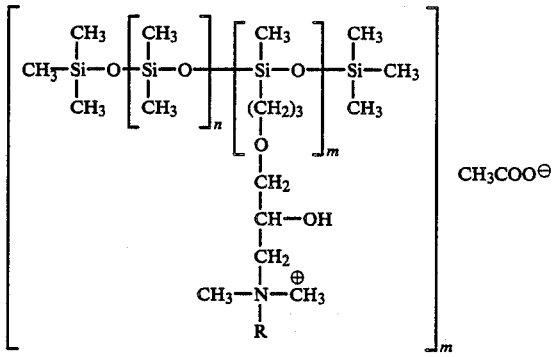

n=50 to 2000 m depends upon the nitrogen content of between 1% to 4%.

The quaternised siloxane, which may be termed a polysiloxanedimethylalkylammoniumacetate copolymer, preferably in a 30% aqueous solution has a density of 1.053 g/$cm^3$ at 20° C. and a viscosity of 60 to 100 mPa.s at 20° C.; the pH of a 30% solution being 6 to 7.

In addition, the silicone oil of component (A) can be silicone elastomer, as described on pages 1342 to 1343 in "Textilpraxis International", December 1983. A mixture of the said substances can also be used as component (A).

Component (B), the fatty acid condensation product, is preferably a condensation product of an aliphatic long chain, especially a $C_1$–$C_{22}$, saturated or unsaturated monocarboxylic acid, with a polyamine or an addition product derived from a polyamine with ethylene oxide or propylene oxide. The condensation product should preferably correspond to the formula

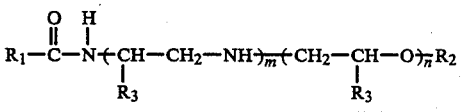

wherein $R^1$=is an alkyl or alkylene group with 9 to 21 carbon atoms;

$R^2$=

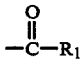

or hydrogen;

$R^3$=hydrogen or methyl;

m=1 to 4;

n=0 to 3.

In particular, stearic acid or oleic acid may be the monocarboxylic acids, and diethylenetriamine and diethylenetriamineethanolamine may be the polyamine.

Component (C) is preferably a cation-active alkoxylated starch, which is, for example, described in DE-PS No. 21 55 941, or a cation-active alkoxylated cellulose.

Preferably the cation-active alkoxylated starch has the formula:

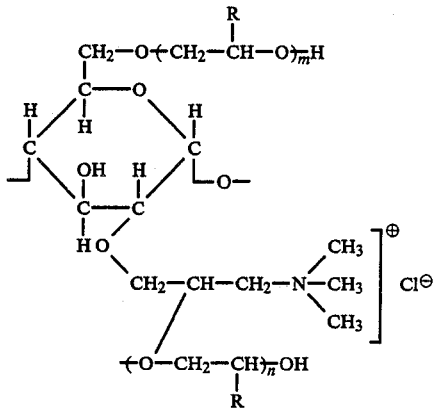

wherein

R=H or $CH_3$ m=1 to 3 n=0 to 3

Preferably the alkoxy content is between 4% to 10% and the nitrogen content between 0.1% to 0.5%.

The cationic dispersing agent for the silicone oil component (A) can be any cation-active emulsifying agent. In particular for this invention, a cation-active imidazolinium salt is preferred, especially a compound having the structure:

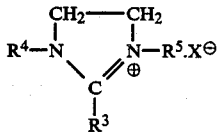

wherein $R^3$ is a long chain saturated or unsaturated hydrocarbon radical especially having 10 or more carbon atoms; $R^4$ represents hydrogen or an alkyl radical, especially one with 1 to 5 carbon atoms, optionally the alkyl radical is substituted, more particularly is a hydroxy terminated radical; $R^5$ is a lower alkyl radical, in particular a $C_1$–$C_4$ alkyl radical; X is an anionic radical preferably a halide radical, or an anionic group, particularly the group:

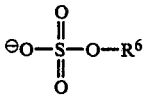

wherein $R^6$ represents a $C_1$–$C_4$ alkyl group or is the acetate group. Preferably the cation-active dispersing agent is used in an amount of 2 to 10%, based on the silicone.

Furthermore, component (A) contains an alkoxylated fatty amine, in particular an ethoxylated fatty amine, in an amount up to 10% by weight, based on the silicone.

Preferably, the post-wash-aid of the invention contains component (A) in an amount of 0.5 to 20% by weight; particularly 3 to 8% by weight: Component (B) in an amount of 0.5 to 15% by weight; particularly 2 to 8% by weight: and component (C) in an amount of 1 to 15% by weight, particularly 2.5 to 7.5% by weight. The remainder consists of water.

In addition, the invention preferably contains perfumes, preservatives, colorants and organic acids, particularly organic aliphatic carboxylic acids, such as citric acid or acetic acid, to maintain a pH, preferably within the range of 3 to 5.

The components of the invention are characterised by a relatively high substantivity towards textile fibres, i.e. they have an affinity towards cold dyed material, particularly cotton, so that the invention is particularly suited to the treatment of washing or clothes made partly of cotton.

Since the components of the post-wash-aid of the invention can easily be rinsed out, there is no risk that they will accumulate on the fibres and thus adversely affect the properties of the wash when used repeatedly.

Additionally, the post-wash-aid of the invention does not facilitate increased re-soiling of the treated wash, it does not cause yellowing of material, as can happen with existing softeners.

In practice, the post-wash-aid of the invention is added to the final rinse in an amount of 50 to 80 g, given that the volume of water of the final rinse is approximately 20 liters.

The post-wash-aid of the invention can be formulated via two methods:

METHOD 1

Cation-active alkoxylated starch is dispersed in water. This dispersion is heated to 80° C. to 90° C., under vigorous stirring; a fairly viscous, clear solution is formed. This is then cooled to 20° C. to 25° C., and the solution mixed with the cationic fatty acid condensation product, dispersed in water. As soon as a uniform dispersion has been obtained, a silicone dispersion which has been dispersed with a cationic dispersing agent is carefully added under vigorous, slow stirring. By means of an acid, the dispersion is adjusted to an acid pH value. Finally, colorants, perfume and a preservative are added.

METHOD 2

The starch solution is prepared as previously described. The cationic fatty acid condensation product is added in solid form to the solution which has been heated to 90° C., and the whole is vigorously stirred. Stirring is continued until the stable dispersion is formed. This is then cooled to 20° to 25° C., and the method continues as described above.

EXAMPLE 1

This example describes a formulation which will produce a post-wash-aid in accordance with the invention and which is made by method 1.

1. 600 parts by weight of an approximately 50% aqueous dispersion of an approximately 1:1 mixture of a polydimethylsiloxane with viscosity about 5.000 $mm^2s^{-1}$, and a paraffin wax with melting range 50° to 55° C., emulsified with a dioleylimidazoline sulphate and a cocoamine ethylene oxide adduct having 5 to 10 moles ethylene oxide;

2. 4.50 parts of weight of an approximately 30% dispersion of propylaminoethylaminedimethylpolysiloxane with an amine content of 0.1 to 0.5, cationically emulsified with dioleylimidazoline sulphate and cocoamine ethylene oxide adduct, having 5 to 10 moles ethylene oxide;

3. 10.00 parts by weight of approximately 20% aqueous dispersion of distearic acid-dipropylene triamine ethanolamine condensate adjusted to pH 3 with acetic acid;

4. 7.50 parts by weight of hydroxypropyltrimethylammonium chloride-hydroxypropyl starch ether with a N-content about 0.25% and a propoxy content of about 7%;

5. 0.20 parts by weight of colorant, perfume and preservative;

6. 71.80 parts by weight of water.

The pH of this composition is about 4. It is a thin milky-looking dispersion with a viscosity of about 120 mPa.s.

EXAMPLE 2

A post-wash treatment composition in accordance with the invention is formulated using method 2.

1. As per example 1 (silicone/wax mixture) 6.20 parts by weight;

2. Distearic acid-diethylene triamine condensate (mp=approx. 90° C.) 3.25 parts by weight;

3. As number 4 in example 1 (starch ether) 5.00 parts by weight;

4. Citric acid monohydrate 3.00 parts by weight;

5. Colorant, perfume, preservative 0.20 parts by weight;

6. Water 82.35 parts by weight.

The pH of this compositions is 3 to 4. It is a thin, milky dispersion with viscosity about 80 mPa.s.

EXAMPLE 3

Evaluation of ironing capability:

In order to evaluate ironing capability, the composition of example 2 is added to the final rinse in a household washing machine in an amount of 50 to 80 g, the wash consists of material made of cotton or a mixture of cotton and polyester, which previously had been washed with a conventional washing powder, at a temperature of 95° C.

The ironing test is carried out as follows:

An iron, at a temperature of 200°±10° C. is passed over a measured piece of test material at constant iron pressure upon the material maintained by means of a weight attachment, and the material itself is kept uniformly stretched out. The test is carried out in two phases: an initial phase, where the fabric has 30% moisture and an end phase where the fabric is ironed dry.

For comparative purposes, untreated fabrics, and fabrics treated with a conventional ironing-aid were subjected to the ironing test.

The result of these tests are collated in table 1.

TABLE 1

| | Ironing values for unfinished (non-dressed) cotton fabric | | | | |
|---|---|---|---|---|---|
| | Prior to ironing: sprayed with | 1st phase ironing tractive force cN (g) | Time (in sec) | 2nd phase tractive force cN (g) | Time (in sec) |
| Untreated | 30% water | 216 (220) | 30 | 216 (220) | 20 |
| Ironing Aid | 30% ironing aid spray* | 88,3 (90) | 10 | 58,8 (60) | 10 |
| Composition of example 2 | 30% water | 49 (50) | 10 | 29,4 (30) | 10 |

*commercial starch-silicone oil dispersion

The ironing values for untreated fabrics vary by ±10% from the mean values given in the table. This applies particularly to the tractive force. The probable reason for this is the uneveness of the roughness of the surface of the fabric. The plainly lower ironing values determined with the "ironing aid" and the composition of example 2 show an essentially lower variation (maximum 5%) so the reproductivity is improved by virtue of a reduction in the surface roughness of treated fabric.

EXAMPLE 4

Evaluation of the washability of the composition according to the invention.

Washing samples made of 100% cotton are washed 5 and 6 times, respectively, at 95° C. and 60° C. with a conventional washing powder, and then treated in the final rinse with 80 g of the substance described in example 2.

For comparative purposes, tests were carried out on untreated samples of clothing washed in exactly the same way as above, as well as samples treated with a standard ironing aid. The ironing test was employed for testing. Mean values were obtained from 6 separate smoothness tests, and these are given in the accompanying FIGS. 1 and 2.

The ironing values of FIGS. 1 and 2 show the traction force extrapolated to the same time t=10 sec. of after treated or untreated cotton fabrics washed at 95° C. (5 times) and 60° C. (6 times), respectively. As FIGS. 1 and 2 show, surprisingly it appears that an ironing value differing only marginally from the smoothness value occurs even after the first repetition of the after-wash treatment.

This suggests that the post-wash-aid of the invention is washed out of the sample wash both at 95° C. and 60° C. No unwanted substantive effect occurs when the composition of the invention is added to the wash.

EXAMPLE 5

Evaluation of "fluffiness" (fullness).

Face flannels of 100% cotton washed in the conventional way are treated in the final rinse, once with the composition of example 2 at a concentration of 50 to 80 g/20 liters and once for comparison with a conventional fabric softener (LENOR ®*) at the same concentration. Untreated face flannels are used as a further comparison. In all 15 face flannels each are washed twice at 60° C. After drying in air on a clothes stand, the face flannels of the test groups are separated and laid out in piles. The height of the piles is measured after 10 minutes and the results are given in table 2.

*(based on distearyl dimethyl ammonium chloride)

TABLE 2

| Evaluation of fluffiness | |
|---|---|
| Treatment | Height of pile (cm) |
| untreated | 24 |
| LENOR ® | 26 |
| Composition of example 2 | 27 |

The height of the pile is taken as a measure of the fluffiness of the face flannels and also the loosening of the individual fibres. Surprisingly, the height of the pile was found to be greater with the composition of the invention, than with the well-known fabric softener.

EXAMPLE 6

Evaluation of absorptivity (ability to dry):

Absorptivity is a measure of the ability of textile fabrics (Terry Cloth) to take up moisture. The absorptivity is determined using the equilibrium method described in DIN 53294. 3 cm wide and 25 cm long strips of undressed cotton (100% cotton fabric) of superficial weight 140 g/m$^2$ are dipped by one end into distilled water, which because of capillary action in the fabric and according to the absorptive capacity of the fabric will rise to a higher or lesser level. The levels after 5 minutes test time are given in table 3.

TABLE 3

| Water level after 5 minutes test time | |
|---|---|
| Treatment | Water level in cm |
| untreated | 8.2 |
| LENOR ® | 4.2 |
| Composition of example 2 | 7.0 |

As table 3 above shows the absorptivity with the composition of example 2 approaches that of untreated fabrics.

We claim:

1. A textile post-wash-aid composition comprising an aqueous vehicle, and dispersed in said aqueous vehicle:
   (A) a silicone oil characterized by a viscosity of 1,000 to 10,000 mm$^2$s$^{-1}$;
   (B) a cationic fatty acid condensation product comprising a $C_{10-22}$ aliphatic monocarboxylic acid condensate with a polyamine or with an addition product of a polyamine with ethylene oxide or with propylene oxide, and
   (C) a cationic film former selected from the group consisting of cation-active alkoxylated starch and cation-active alkoxylated cellulose.

2. The composition of claim 1 comprising a cationic dispersing agent in sufficient amount to disperse (A), (B) and (C) in said aqueous vehicle.

3. The composition of claim 2 wherein said dispersing agent is a cation-active imidazolinium salt.

4. The composition of claim 3 wherein (A) is methyl silicone together with up to 10% by weight of said silicone of an ethoxylated fatty amide, and wherein the pH of said composition is 3–5.

5. A new post-wash-aid composition for textiles comprising: an aqueous vehicle, and components (A), (B) and (C) dispersed in that aqueous vehicle, wherein, Component (A) is a silicone oil selected from the group consisting of (1) polyalkyl silicone oils characterized by a viscosity of 1,000 to 10,000 mm$^2$s$^{-1}$, (2) silicone oils of the following structural formula

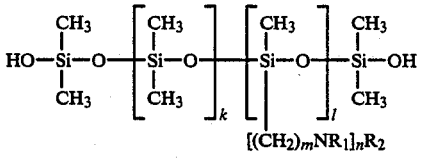

wherein $R_1$ is H or —$CH_2$—$CH_3$, $R_2$ is —$CH_2$—$CH_3$, m is 2 to 3, n is 1 to 2, k is 50 to 2,000, and l is an integer such that the silicone oil contains 0.1% to 2% nitrogen; and (3) quaternized siloxanes of the structural formula

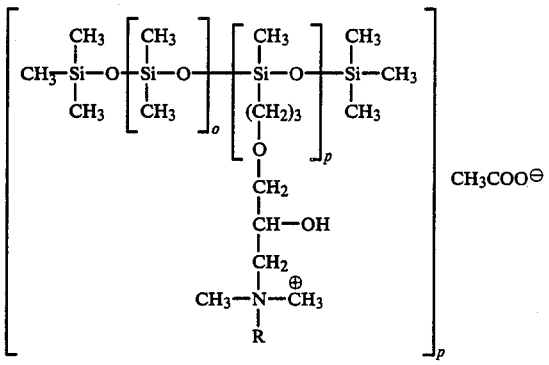

wherein

R is a lower alkyl radical, o is an integer of 50 to 2,000, and p is an integer such that the siloxane contains a nitrogen content of between 1% and 4%;

Component (B) is a cationic fatty acid condensation product selected from the group consisting of (1) a condensation product of an aliphatic long chain, saturated or unsaturated monocarboxylic acid with a polyamine and (2) a condensation product of an aliphatic long chain, saturated or unsaturated monocarboxylic acid with an addition product derived from a polyamine and ethylene oxide or propylene oxide, having the formula

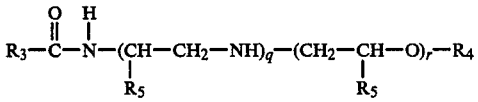

wherein $R_3$ is an alkyl or alkylene group with 9 to 21 carbon atoms, $R_4$ is

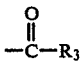

or hydrogen, $R_5$ is hydrogen or methyl, q is 1 to 4, and r is 0 to 3; and,

Component (C) is a cationic film-former selected from the group consisting of a quaternary cationic alkoxylated starch ether of the formula

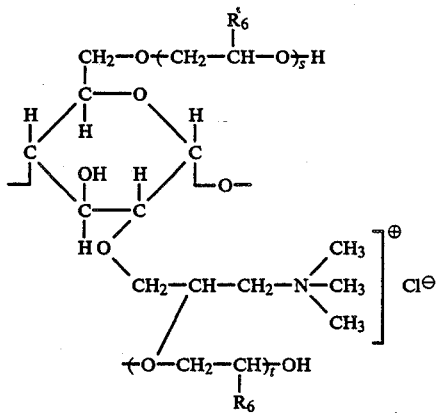

wherein $R_6$ is H or $CH_3$, s is 1 to 3, t is 0 to 3, and quaternary cationic alkoxylated cellulose.

6. A composition as claimed in claim 5 in which the silicone oil is an alkylsilicone.

7. A composition as claimed in claim 6 in which the silicone oil is a methylsilicone oil.

8. A composition as claimed in claim 5 in which component (A) is an amino functional siloxane.

9. A composition as claimed in claim 8 in which component (A) further comprises up to 10% by weight, based on the silicone component, of an alkoxylated fatty amine.

10. A composition as claimed in claim 9 in which the alkoxylated fatty amine is an ethoxylated fatty amine.

11. The textile post-wash-aid composition of claim 5 wherein the fatty acid condensation product is a condensation product of an aliphatic long chain, saturated or unsaturated monocarboxylic acid with a polyamine.

12. A composition as claimed in claim 11 in which the long chain monocarboxylic acid has 10 to 22 carbon atoms in the chain.

13. A composition as claimed in claim 5 in which the cationic dispersing agent for component (A) is a cationactive imidazolinium salt.

14. A composition as claimed in claim 13 in which the imidazolinium salt has the following structural formula:

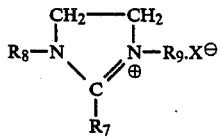

in which $R_7$ is a saturated or unsaturated long chain hydrocarbon radical, $R_8$ is hydrogen or an optionally substituted alkyl or hydroxyalkyl radical, $R_9$ is a lower alkyl radical, and X is an anionic radical or group.

15. A composition as claimed in claim 14 in which $R_7$ includes a radical containing at least 10 carbon atoms; $R_8$ includes a ratical containing up to 5 carbon atoms; $R_9$ includes a radical containing up to 4 carbon atoms; and X is a halide radical or a group:

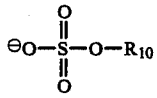

where $R_{10}$ is $C_1$–$C_4$-Alkyl, or the acetate group.

16. A composition as claimed in claim 5 in which the components are present in the following proportions by weight of the composition: 0.5% to 20% component (A); 0.5% to 15% component (B); 1% to 15% component (C), and the remainder is water.

17. A composition as claimed in claim 16 in which the proportions by weight of the composition are 3% to 8% component (A); 2% to 8% component (B); 2.5% to 7.5% component (C), and the remainder is water.

18. A composition as claimed in claim 5 which contains acid, and has a pH of 3 to 5.

19. A composition as claimed in claim 5 further comprising a paraffin wax having a melting point at least about 40° C.

20. A process of producing a new post-wash-aid composition for textiles which increases the sliding effect of an iron, softens and increases the water absorptivity of the textiles, comprising:

(a) mixing water and a cationic film-former selected from the group consisting of a quaternary cationic alkoxylated starch ether of the formula

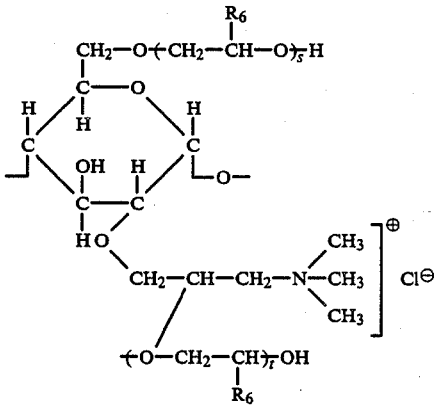

wherein $R_6$ is H or $CH_3$, s is 1 to 3, and t is 0 to 3, and quaternary cationic alkoxylated cellulose to produce a uniform dispersion;

(b) heating the dispersion to a temperature of 80° C. to 90° C., while applying continuous stirring to form a viscous, clear solution;

(c) cooling the solution to 20° to 25° C.;

(d) mixing the solution with an aqueous dispersion of a cationic fatty acid condensation product selected from the group consisting of (1) a condensation product of an aliphatic long chain, saturated or unsaturated monocarboxylic acid with a polyamine and (2) a condensation product of an aliphatic long chain, saturated or unsaturated monocarboxylic acid with an addition product derived from a polyamine and ethylene oxide or propylene oxide, having a formula

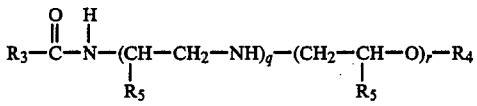

wherein $R_3$ is an alkyl or alkylene group with 9 to 21 carbon atoms, $R_4$ is

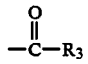

or hydrogen, $R_5$ is hydrogen or methyl, q is 1 to 4, and r is 0 to 3;

(e) adding an aqueous dispersion of at least one silicone oil selected from the group consisting of (1) polyalkyl silicone oils characterized by a viscosity of 1,000 to 10,000 $mm^2s^{-1}$, (2) silicone oils of the following structural formula

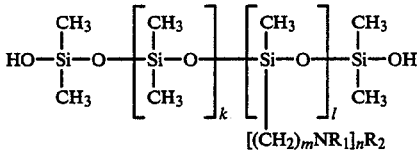

wherein $R_1$ is H or $—CH_2—CH_3$, $R_2$ is $—CH_2—CH_3$, m is 2 to 3, n is 1 to 2, k is 50 to 2,000, l is an integer such that the silicon oil contains 0.1% to 2% nitrogen, and (3) quaternized siloxanes of the structural formula

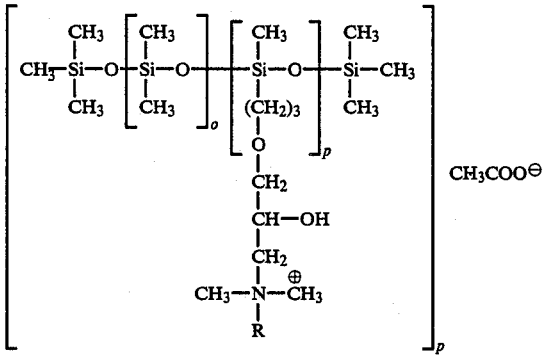

wherein

R is a lower alkyl radical, o is an integer of 50 to 2000, and p is an integer such that the siloxane contains a nitrogen content of between 1% and 4%; and (f) adjusting the pH to a value less than 7.

21. The process of claim 20 wherein the cationic fatty acid condensation product is added to the solution at 80° to 90° C. with vigorous stirring.

22. The process of claim 20 wherein the composition further comprises a paraffin wax having a melting point at least about 40° C.

23. The process of claim 22 wherein paraffin wax is added to the composition with stirring to form a uniform dispersion.

24. The process of claim 20 wherein a colorant, a preservative and a perfume are included in the composition.

25. The process of claim 20 wherein the silicone oil is an alkylsilicone.

26. The process of claim 25 wherein the silicone oil is a methylsilicone oil.

27. The process as claimed in claim 20, in which the aqueous dispersion of the silicone is prepared with the aid of an imidazolinium salt of a formula

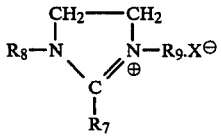

in which $R_7$ is an optionally unsaturated hydrocarbon radical having 10 or more carbon atoms, $R_8$ is hydrogen or an optionally substituted $C_1$–$C_5$ alkyl radical, $R_9$ is a lower alkyl radical, and X is an anionic radical or group.

28. A process as claimed in claim 20 in which the silicone oil and optional paraffin are added in an amount from 0.5% to 20% by weight of the final composition; the cationic fatty acid condensation product is added in an amount from 0.5% to 15% by weight of the final composition; and the cationic film former is added in an amount from 1% to 15% by weight of the final composition.

29. A process for facilitating ironing of clothes which comprises adding the composition of claim 1 to the last rinse during the washing process of said clothes.

30. A process for facilitating ironing of clothes which comprises adding the composition of claim 5 to the last rinse during the washing process of said clothes.

31. A process for facilitating ironing of clothes which comprises adding the composition of claim 16 to the last rinse during the washing process of said clothes.

32. A process for increasing the absorptivity of fabrics for water which comprises adding the composition of claim 1 to the last rinse during the washing process of said clothes.

33. A process for increasing the absorptivity of fabrics for water which comprises adding the composition of claim 5 to the last rinse during the washing process of said clothes.

34. A process for increasing the absorptivity of fabrics for water which comprises adding the composition of claim 16 to the last rinse during the washing process of said clothes.

* * * * *